US008387173B2

(12) United States Patent
Lake

(10) Patent No.: US 8,387,173 B2
(45) Date of Patent: Mar. 5, 2013

(54) CISTERN ASSEMBLY

(75) Inventor: Antony James Lake, Meringandan West (AU)

(73) Assignee: Metaflush Pty Ltd, Meringandan West, Queensland (AU)

( * ) Notice: Subject to any disclaimer, the term of this patent is extended or adjusted under 35 U.S.C. 154(b) by 271 days.

(21) Appl. No.: 12/679,444

(22) PCT Filed: Sep. 19, 2008

(86) PCT No.: PCT/AU2008/001401

§ 371 (c)(1), (2), (4) Date: Apr. 22, 2010

(87) PCT Pub. No.: WO2009/039561

PCT Pub. Date: Apr. 2, 2009

(65) Prior Publication Data

US 2010/0251470 A1 Oct. 7, 2010

(30) Foreign Application Priority Data

Sep. 24, 2007 (AU) ..... 2007905179

(51) Int. Cl.
*E03D 1/02* (2006.01)

(52) U.S. Cl. ..... 4/365

(58) Field of Classification Search ..... 4/365, 353, 4/405–409; *E03D 1/20, 1/14, 11/00, 1/012, E03D 5/09, 1/00, 11/18*

See application file for complete search history.

(56) References Cited

U.S. PATENT DOCUMENTS

| | | | | |
|---|---|---|---|---|
| 5,464,037 | A * | 11/1995 | Younes | 137/410 |
| 7,219,375 | B2 * | 5/2007 | Steadman | 4/325 |
| 7,640,604 | B2 * | 1/2010 | Cummings | 4/421 |

FOREIGN PATENT DOCUMENTS

| | | |
|---|---|---|
| CN | 1492112 | 4/2004 |
| DE | 19504783 | 8/1996 |
| DE | 10324856 | 12/2004 |
| WO | 02/14615 | 2/2002 |

* cited by examiner

*Primary Examiner* — Lori Baker

(74) *Attorney, Agent, or Firm* — Shoemaker and Mattare

(57) ABSTRACT

A cistern assembly for a flush toilet includes a cistern housing including a cistern lid and a cistern base, a cistern member pivotally attached within the cistern housing, and an actuator to pivot the cistern member relative to the cistern housing to discharge the stored water. The cistern member has a base wall that forms a chamber to store the water and a passageway to discharge the water from the chamber, the passageway has an internal inlet and a cistern outlet and is shaped to siphon water through the passageway. The actuator tilts the cistern member to actuate discharge of water through the passageway so that when the cistern member is pivoted and the passageway is moved below the water level of the stored water of the chamber, water is drawn through the passageway to the cistern outlet until air within the chamber enters the passageway preventing further water from being drawn into the passageway.

24 Claims, 20 Drawing Sheets

A

B

A

B

F5

F6

F7

F8

CISTERN ASSEMBLY

FIELD OF INVENTION

The present invention relates to a flush toilet and urinal systems. The present invention has particular but not exclusive application to a cistern for a flush toilet.

BACKGROUND OF THE INVENTION

A flush toilet system operates by the rapid passage of water from the cistern to the toilet bowl and then into to the underground sewer pipes. Water is stored in the cistern. Water is released from the cistern with the actuating of the flushing mechanism. Water passes through a cistern outlet into the bowl. When the water has drained from the cistern, the outlet valve reseals about the outlet and water from the mains water supply refills the cistern.

The outlet valve is usually a rubber or plastic gasket. Wearing of the cistern outlet valve prevents effective sealing of the outlet. Dirt in the water or scale deposits from chemically hard water can also obstruct the proper sealing of the cistern outlet valve. Often the amount of water that leaks through the cistern outlet valve as a result of ineffective sealing is very small and the leakage problem goes unnoticed. Even if a small trickle is noticed running down the inside of the toilet bowl, a person often does not bother replacing the seal because the trickle appears minimal. As the leakage problem causes no inconveniences to a person and the replacement of the cistern outlet valve itself is troublesome, there is little incentive to fix the leakage problem. Over a prolonged period, however, a significant volume of water escapes into the toilet bowl and is lost into the sewerage system. The loss of water from the cistern through an ineffective cistern outlet valve can be financially and economically significant particularly in times of drought.

OBJECT OF THE INVENTION

It is an object of the present invention to provide an alternate cistern assembly which overcomes at least in part one or more of the above mentioned disadvantages.

SUMMARY OF THE INVENTION

In one aspect the present invention broadly resides in a cistern assembly for a flush toilet including a cistern housing;

a cistern member pivotally attached within the cistern housing, the cistern member has a base wall that forms a chamber to store water and a passageway to discharge water from the chamber, the passageway has an internal inlet and a cistern outlet and is shaped to siphon water through the passageway; and an actuator associated with the cistern member to pivot the cistern member relative to the cistern housing wherein when the cistern member is pivoted and the passageway is moved below the water level of the stored water of the chamber, the water is drawn through the passageway to the cistern outlet until air within the chamber enters the passageway preventing further water from being drawn into the passageway.

The cistern housing preferably includes a cistern lid and a cistern base.

In another aspect the present invention broadly resides in a cistern assembly for a flush toilet including a cistern housing;

a cistern member pivotally attached within the cistern housing, the cistern member has a base wall that forms a chamber to store water and a passageway to discharge water from the chamber, the passageway has an internal inlet and a cistern outlet and is shaped to siphon the water when the hydrostatic pressure within the passageway is lower than the atmospheric pressure in the chamber thereby drawing water through the passageway; and an actuator associated with the cistern member to pivot the cistern member relative to the cistern housing wherein when the cistern member is pivoted and the passageway is moved below the water level of the stored water of the chamber, the water is drawn through the passageway to the cistern outlet until air within the chamber enters the passageway preventing further water from being drawn into the passageway.

The cistern housing preferably includes a cistern lid and a cistern base.

The passageway preferably has a first section formed within the chamber and a second section formed outside the chamber. The first section and the second section enable continuous fluid communication between the internal inlet of the passageway and the cistern outlet.

Preferably, the first section is formed by an inner side wall and the base wall, and the second section is formed by an outer side wall and the base wall.

The first section and the second section are preferably connected by a substantially U-shaped portion.

The first section, the substantially U-shaped portion and the second section preferably form a continuous channel. Preferably, the first section, the substantially U-shaped portion and the second section have internal dimensions that are substantially the same.

The length of the inner side wall preferably determines the length of the passageway and the volume of water to be discharged. In alternative embodiments the inner side wall has an aperture between the chamber and the passageway thereby limiting the volume of water to be discharged. In a preferred alternate embodiment, the inner side wall has a plurality of apertures with removable seals. In this preferred embodiment, the selected seal can be removed or broken to enable the discharge of a defined volume of water.

In the alternative embodiment, the inner side wall preferably has a plurality of apertures and the aperture which defines a predetermined volume of water remains open while at least those apertures defining smaller volumes of water are closed with a seal.

The chamber preferably stores a predetermined volume of water. The chamber preferably stores a predetermined volume of water via means of a cistern inlet.

Preferably, the cistern member has a plurality of passageways to enable different volumes of stored water to be discharged from the chamber. More preferably, the cistern member has two passageways to enable the choice of two different volumes of stored water to be discharged from the chamber.

In the embodiment where there are two passageways, a first passageway enables substantially all of the predetermined volume of water to be discharged from the chamber, and a second passageway enables about half of the predetermined volume of water to be discharged from the chamber. In this embodiment, the first inner side wall is about half the length of the second inner side wall.

In another embodiment where there are two passageways, the first inner side wall is the same length as the second inner side wall and the second inner side wall has an aperture enabling only about half the volume of the water to be discharged from the chamber. In this embodiment the aperture is positioned at about midpoint on the second inner side wall.

Preferably, the first passageway and the second passageway are located on opposite sides of the cistern member.

The cistern member preferably has a substantially semi-circular cross-section.

Preferably, the base wall is substantially concave in shape.

The cistern member is preferably pivotally mounted to the cistern housing.

The cistern member is preferably pivotal about a vertical axis being the central axis through the centre of the cistern member and pivot point. The cistern member can preferably be rotated in a vertical plane about the pivot point of the cistern member.

The cistern member is preferably substantially semi-circular in shape having a center of gravity lower than its pivot point. In an embodiment where the cistern member has a center of gravity lower than its pivot point, the cistern member can preferably right itself returning from an inclined position to an upright position when the cistern member is substantially emptied of water.

Preferably, the actuator is a lever that pivots the cistern member relative to the cistern housing. The lever is preferably moveable by about 20 degrees either side of the pivot axis. In other embodiments the actuator is a timed or movement sensor triggered device to flush the toilet or urinal.

In another aspect the present invention broadly resides in a cistern assembly for a flush toilet including a cistern housing;

a cistern member pivotally attached within the cistern housing, the cistern member has a base wall that forms a chamber to store water and a passageway to discharge water from the chamber, the passageway has an internal inlet and a cistern outlet and is shaped to siphon water through the passageway; and actuator means associated with the cistern member to pivot the cistern member relative to the cistern housing, said actuator means can tilt the cistern member to actuate discharge of water through the passageway, wherein when the cistern member is pivoted and the passageway is moved below the water level of the stored water of the chamber, the water is drawn through the passageway to the cistern outlet until air within the chamber enters the passageway preventing further water from being drawn into the passageway.

The cistern housing preferably includes a cistern lid and a cistern base.

In another aspect the present invention broadly resides in a cistern assembly for a flush toilet including a cistern housing including a cistern lid and a cistern base;

a cistern member pivotally attached within the cistern housing, the cistern member has a base wall that forms a chamber to store water and a passageway to discharge water from the chamber, the passageway has an internal inlet and a cistern outlet and is shaped to siphon water through the passageway; and actuator means associated with the cistern member to pivot the cistern member relative to the cistern housing, said actuator means can tilt the cistern member to actuate discharge of water through the passageway, wherein when the cistern member is pivoted and the passageway is moved below the water level of the stored water of the chamber, the water is drawn through the passageway to the cistern outlet until air within the chamber enters the passageway preventing further water from being drawn into the passageway.

The actuator means preferably can be positioned to tilt and hold the cistern member in a tilted position.

In one preferment, the actuator means includes a lever pivotally mounted to the cistern housing and pivots with the cistern member.

In a first preferred embodiment the actuator means includes a lever portion and a floatation portion as a single integral or assembled member. In this embodiment, the lever portion also includes a transverse pin for use as a latch to abut against the surface of a latch guide. The latch guide preferably extends as a linear flange across the underside of a cistern lid. Preferably the latch guide includes two flanges extending longitudinally either side of an elongate lid aperture. The lever portion extends through the elongate lid aperture and serves as a handle to tilt the cistern member. The integral or assembled member of the lever portion and the floatation portion are preferably captured by one or more member guides which are fixed to the side wall of the cistern member. The integral or assembled member of the lever portion and the floatation portion are preferably captured by the fixed member guides so that it can move up and down according to the water level within the cistern member.

In a second preferred embodiment the actuator means includes a handle means for moving the cistern member relative to the cistern housing and a floatable member for latching the cistern member in the tilted position. The floatable member preferably has an elongate portion and a buoyancy portion. The buoyancy portion is preferably positioned near one end of the floatable member. The buoyancy portion has sufficient buoyancy to cause the floatable member to move up and down with the level of the water in the cistern member.

Preferably the floatable member is positionable in the centre of the cistern member.

The floatable member is preferably captured by two spaced apart member guides that are attached to a side wall of the cistern member.

The floatable member is preferably retained by the member guides so that the floatable member can rise and fall with the level of the water in the cistern member.

The elongate portion preferably has a latch formed at one end to engage a latch guide. The elongate portion in one embodiment has a roller or wheel to facilitate movement of the floatable member along the latch guide.

The handle means preferably includes a button that extends from the cistern member side wall. The button preferably extends through a slot in the cistern housing. The button is preferably attached to or integral with the cistern member.

The handle means is preferably associated with the floatable member so that when the handle member moves laterally the floatable member correspondingly moves laterally. The floatable member, however preferably retains independent movement up and down with the level of the water in the cistern member. The handle means is preferably associated with the floatable member via the member guides fixed to the cistern member side wall.

In another preferred form, the actuator means includes a lever pivotally mounted to the cistern housing and pivots with the cistern member.

The cistern member and other features are similar to those discussed with aspects of the invention.

The cistern lid preferably has one or more guide flanges located on an underside of the lid.

The one or more guide flanges preferably have a substantially arcuate shape.

More preferably, the one or more guide flanges have a concave shape.

Each of the one or more guide flanges preferably have at least one abutment side for retaining the latch or latch portion.

In one embodiment, the lid has an opening through which extends the handle member.

In another embodiment, the cistern base has an opening through which a button can extend. Each of the openings is preferably an arcuate slot.

In the embodiment where the lid has the opening for the handle member, the one or more guide flanges are positioned substantially along the periphery or adjacent the periphery of the opening.

Preferably, there are two guide flanges and each one of the guide flanges is located on a longitudinal side of the arcuate slot.

In another aspect the present invention broadly resides in a flush toilet including a cistern assembly as described above; and a toilet bowl wherein the cistern assembly discharges water into the toilet bowl.

In yet another aspect the present invention broadly resides in a cistern member as described above.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENTS

Figure 1:
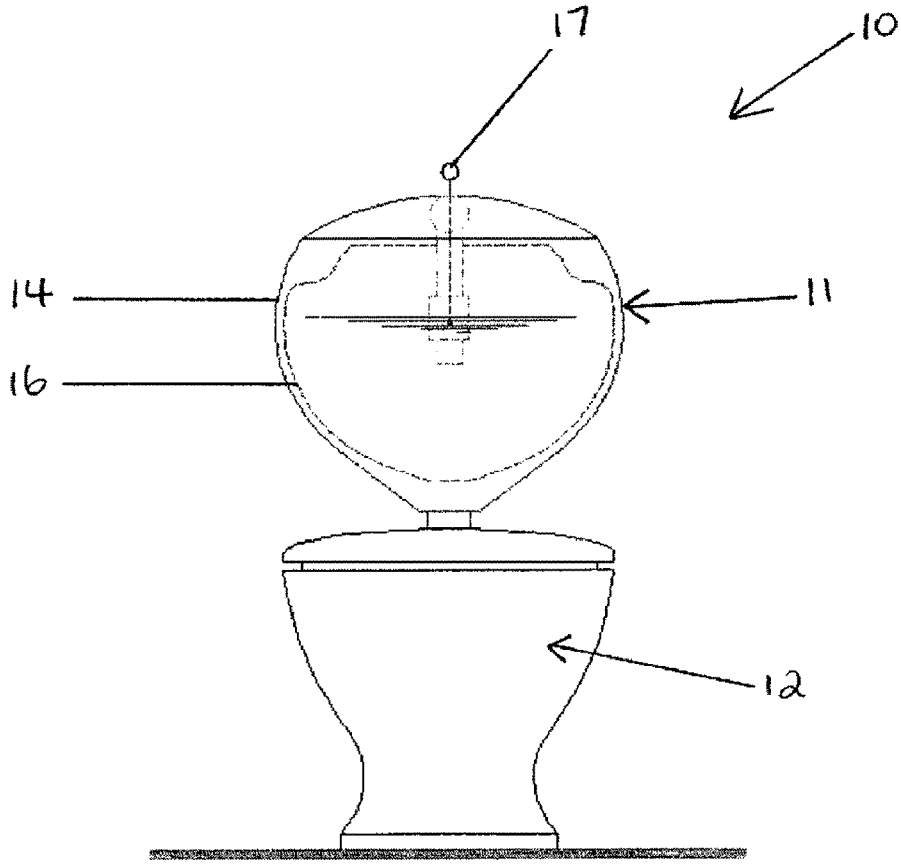
FIG. 1 is a diagrammatic front view of a flush toilet with a cistern assembly according to a first embodiment of the present invention where internal parts of the cistern assembly are shown in phantom.
Figure 2:
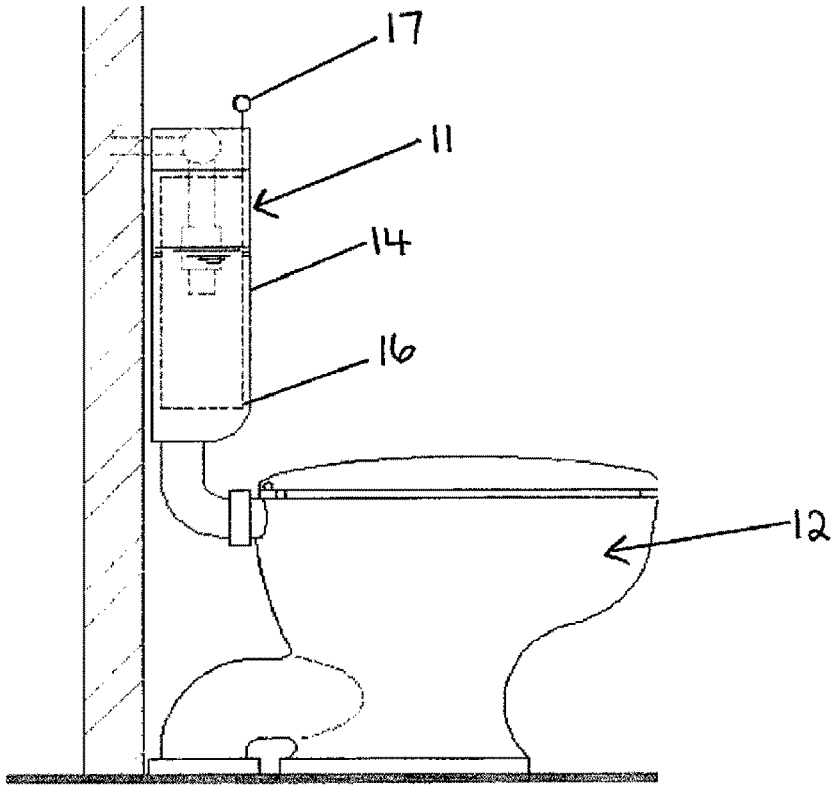
FIG. 2 is a diagrammatic side view of the flush toilet as shown in FIG. 1.
Figure 3:
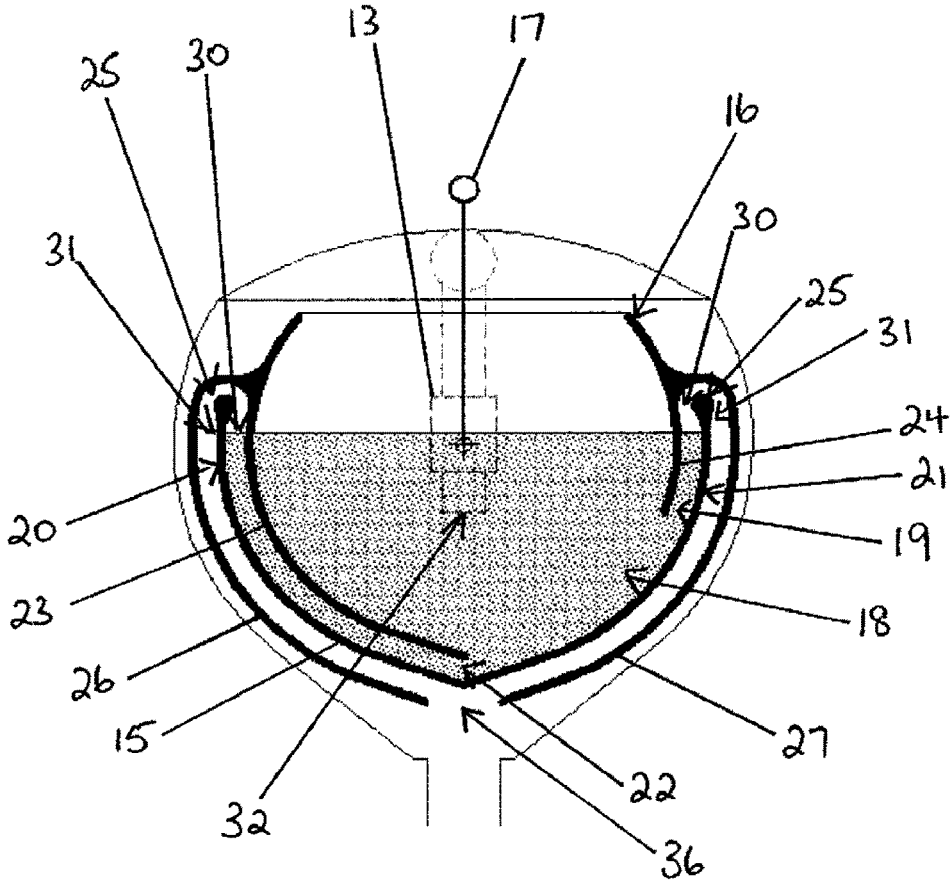
FIG. 3 is a diagrammatic cross sectional view of the cistern assembly as shown in FIG. 1.
Figure 4:
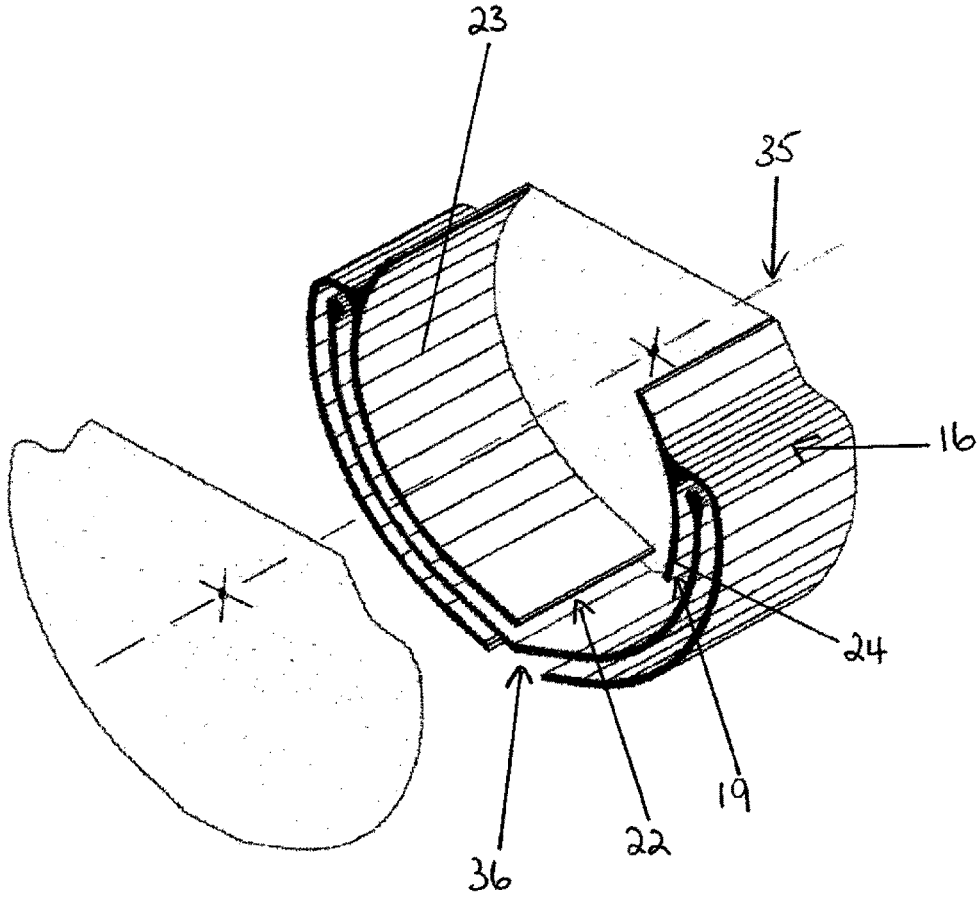
FIG. 4 is a diagrammatic partly exploded view of the cistern member.

With reference to FIGS. 1 to 6, there is shown a flush toilet 10 that has a cistern assembly 11 and a toilet bowl 12. The cistern assembly 11 includes a cistern housing 14, a substantially semi-circular basin 16 forming the cistern member and a lever 17 protruding from a slot (not shown) in the housing 14. The basin 16 is pivotally mounted to the cistern housing 14 and the lever 17 is attached to the basin 16 so that when the lever 17 is moved sideways the basin 16 will tilt relative to the cistern housing 14.

The basin 16 forms a chamber 18 defined by the basin base wall 15. Water from a water supply such as mains water supply fills the chamber 18 to a predetermined volume of water. The volume of water is controlled by a float valve 13 positioned near the water inlet 32. The float valve 13 stops the entry of the water when a predetermined water level is reached.

The basin 16 has two passageways 20, 21 that are located on opposite sides of the basin 16. Water is stored in the chamber 18 and can be discharged through either one of the two passageways 20, 21.

Both passageways 20, 21 have an inner section 30 in continuous communication with an outer section 31.

Each inner section 30 is formed by an inner side wall 23, 24 and the base wall 15 while each outer section 31 is formed by an outer side wall 26, 27 and the base wall 15. An inner section 30 and an outer section 31 are connected by a substantially U-shaped bend 25 to form a continuous channel. The internal dimensions of the inner section 30, the outer section 31 and the substantially U-shaped bend 25 are substantially the same to optimize the siphoning action through each passageway 20, 21. Water enters the passageways 20, 21 via the internal inlet 22, 19 respectively and passes out through the cistern outlet 36.

The two passageways 20, 21 are of different lengths for discharging a different volume of water. The different lengths of the passageways 20, 21 are formed by inner side walls 23, 24 respectively having different lengths. The inner side wall 24 of the passageway 21 is about half of the length of the inner side wall 23 of passageway 20.

Figure 5:
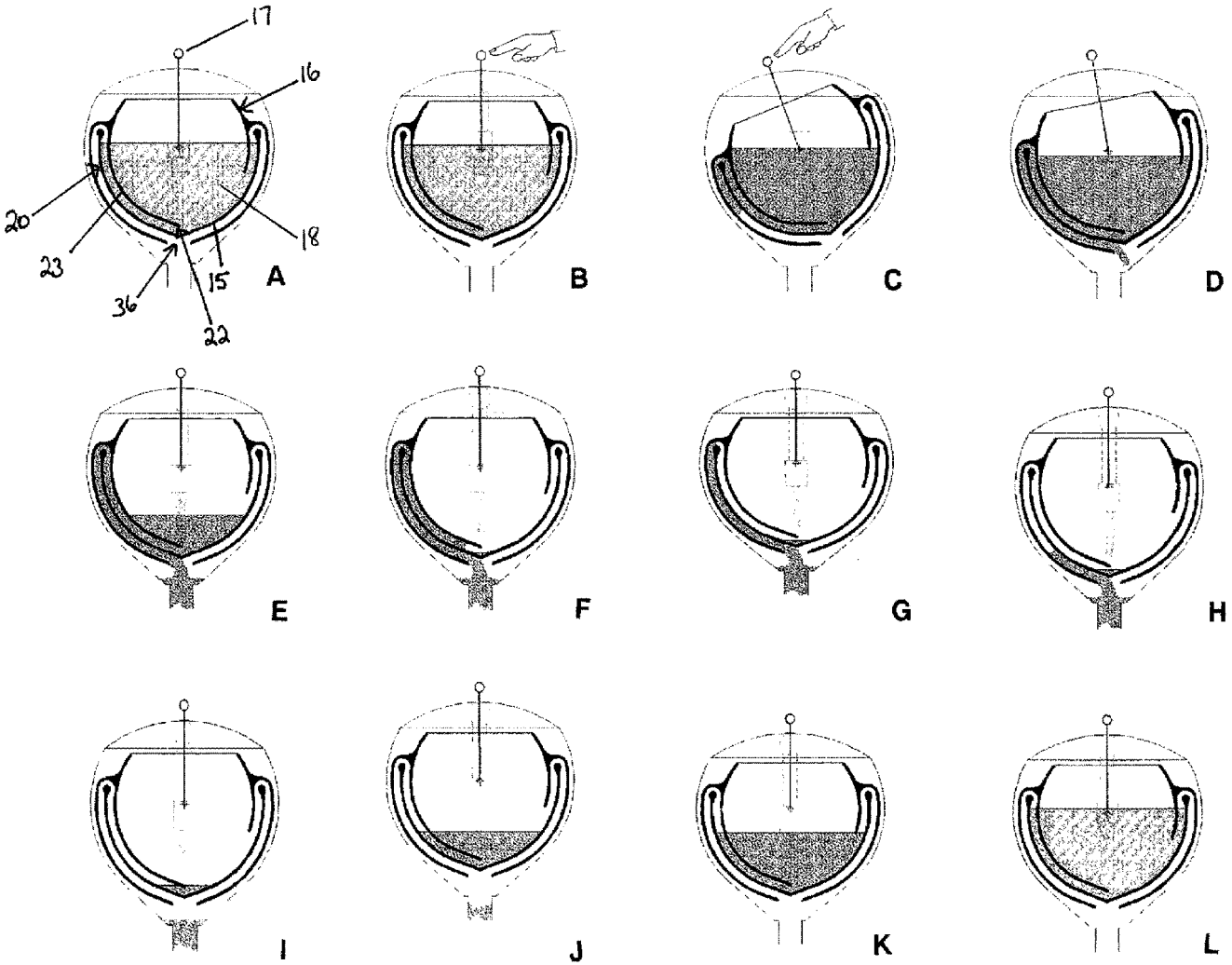
FIG. 5 shows a series of diagrammatic views of the cistern assembly as shown in FIG. 3 in a sequence of steps during a full flush of the flush toilet.

The basin 16 is tilted within the cistern housing 14 using a lever 17. When the lever 17 is moved in a sideways direction, the basin 16 pivots about a vertical axis 35 being the central axis through the centre of the basin 16 and the pivot point. The basin 16 can be rotated in a vertical plane about the pivot point of the basin 16. The lever 17 can be pivoted about 20 degrees to either the left or the right of the vertical pivot axis 35. With reference to FIG. 5, tilting the basin 16 to the left of the pivot axis 35 performs a full flush while tilting the basin 16 to the right of the pivot axis 35 performs a half flush.

The basin 16 is substantially semi-circular in shape having a center of gravity lower than its pivot point. The basin 16 can right itself returning from an inclined position to an upright position when the basin 16 is substantially emptied of water.

In use, when the lever 17 is moved to tilt the basin 16 within the cistern housing 14 in an anticlockwise direction (as shown in FIG. 5), the passageway 20 is lowered. When the passageway 20 is lowered below the water level of the stored water a siphoning action is established. The siphoning action draws the water from the chamber 18 into the internal inlet 22 of the passageway 20 and out through the cistern outlet 36. The water discharged through the cistern outlet 36 flows into the toilet bowl 12 to flush the toilet bowl 12.

Water is discharged through the passageway 20 until air enters the passageway 20 via internal inlet 22 and breaks the siphoning action. As the length of the inner wall 23 of the passageway 20 locates the internal inlet 22 near the bottom of the chamber 18, air enters the left passageway 20 when substantially all the stored water is discharged from the chamber 18.

When the water level within the basin 16 reaches a defined point, the float valve 13 opens and water enters the basin 16 via the water inlet 32 to refill the basin 16 to the predetermined volume.

Figure 6:
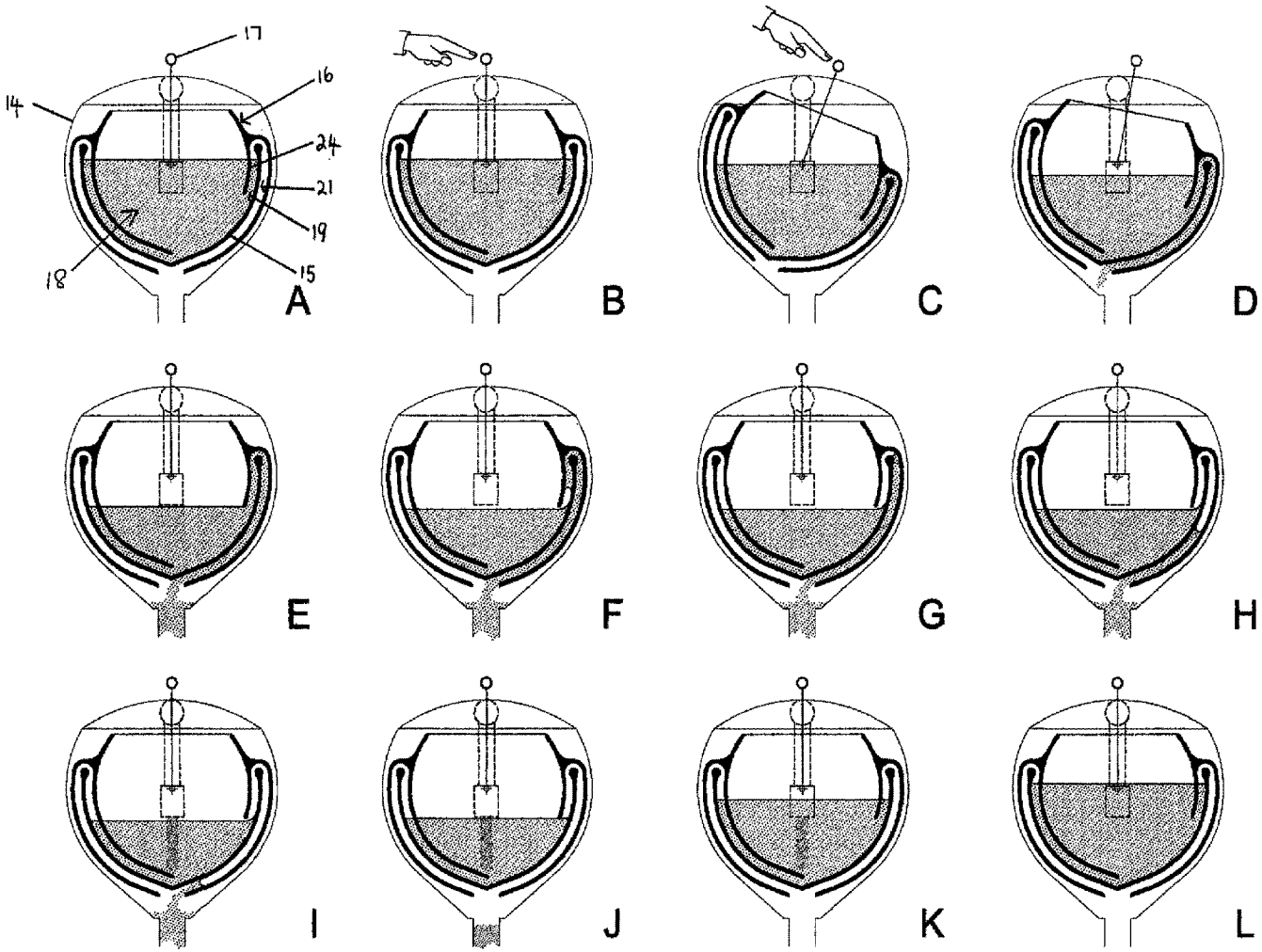
FIG. 6 shows a series of diagrammatic views of the cistern assembly as shown in FIG. 3 in a sequence of steps during a half flush of the flush toilet.
Figure 7:
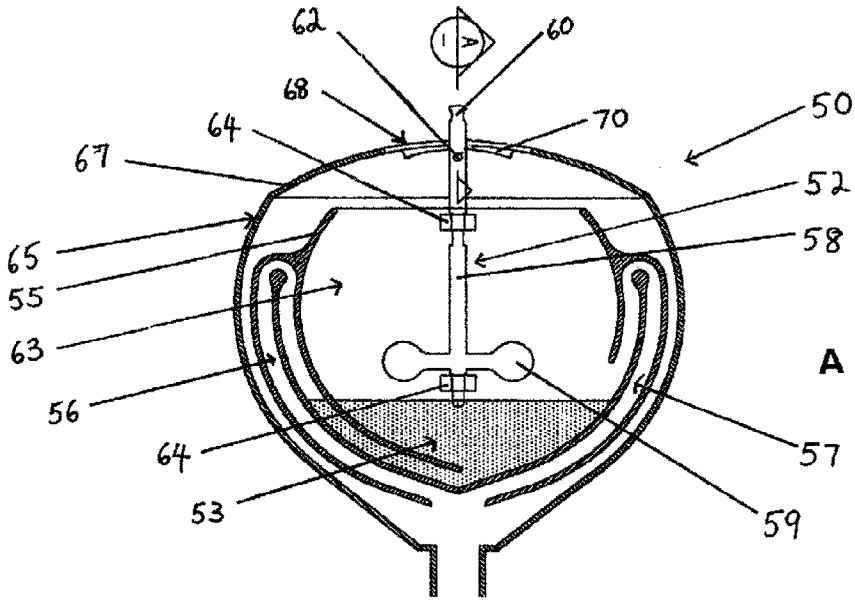
FIG. 7A is a cross sectional view of a cistern assembly according to a second embodiment of the cistern assembly showing a low water level and FIG. 7B is a part sectional view of a cistern actuator indicated by the arrow head A of FIG. 7A.
Figure 7:
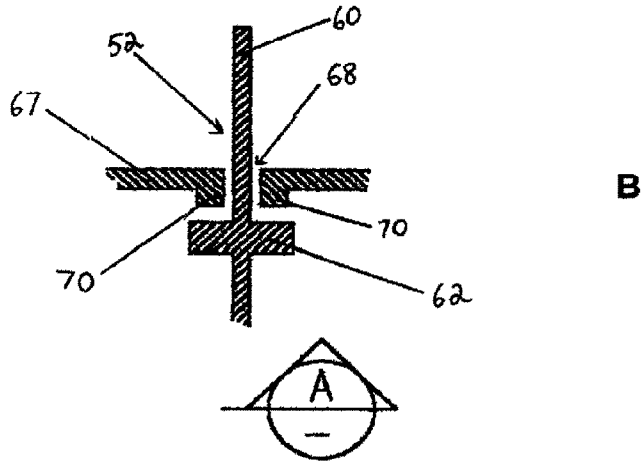
Figure 8:
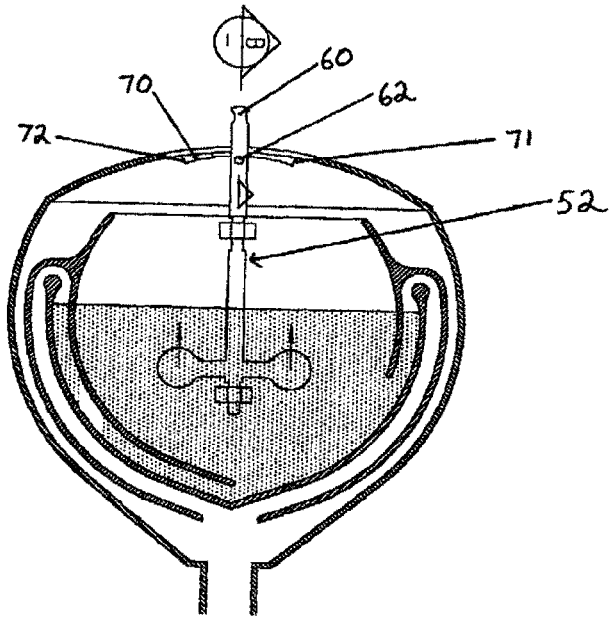
FIG. 8A is a cross sectional view of a cistern assembly as shown in FIG. 7A showing a high water level and FIG. 8B is a part sectional view of the cistern actuator indicated by the arrow head B of FIG. 8A.
Figure 8:
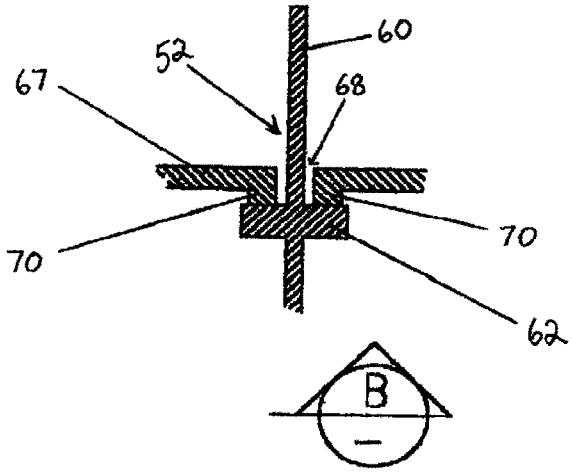
Figure 9:
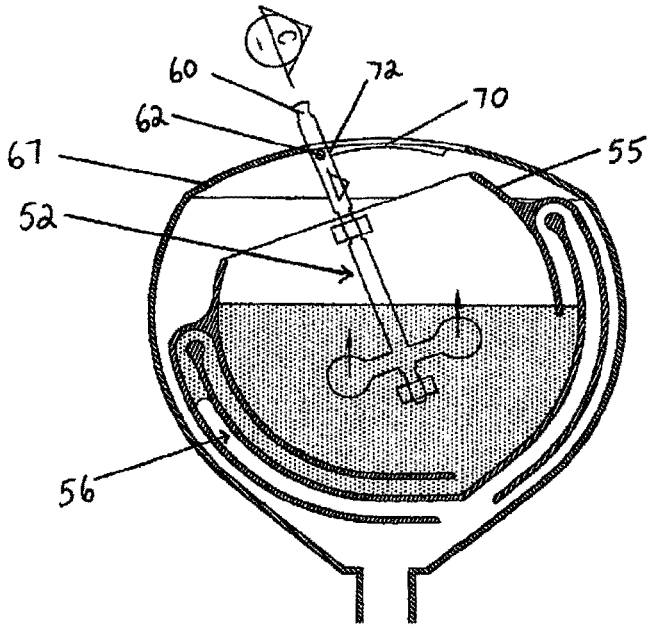
FIG. 9A is a cross sectional view of a cistern assembly as shown in FIG. 7A showing the tilt of the cistern member at the start of a full flush and FIG. 9B is a part sectional view of the cistern actuator indicated by the arrow head C of FIG. 9A.
Figure 9:
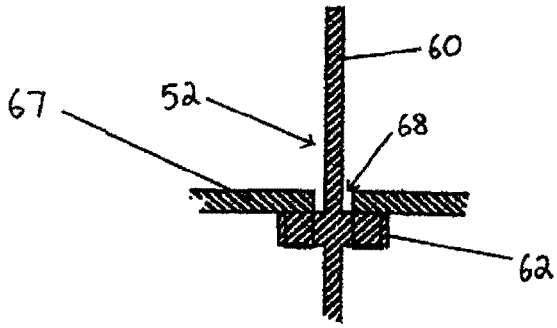
Figure 9:
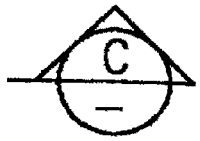

When the lever 17 is moved to tilt the basin 16 within the cistern housing 14 in a clockwise direction (as shown in FIG. 6), the passageway 21 is lowered. A siphoning action is established when the passageway 21 is lowered below the water level of the stored water. Since the inner wall 24 of the passageway 21 is about half the length of the inner wall 23 of the passageway 20, air enters the passageway 21 through the higher internal inlet 19 to break the siphoning action after about half of the stored water has been discharged from the chamber 18. Water from water supply enters the basin 16 via the water inlet 32 to refill the basin 16 to the predetermined volume when the float valve 13 opens.

With reference to FIGS. 7 to 10, there is shown a second embodiment of a cistern assembly 50. The cistern assembly 50 is similar to the cistern assembly 11 described above, except that the cistern assembly 50 has a floatable lever 52 that can rise and fall with the level of water in the chamber 53. The buoyancy of the floatable lever 52 enables the floatable lever 52 to be positioned to hold the basin 55 in a tilted position to actuate discharge of water through the passageway 56 or 57.

The floatable lever 52 has an elongate portion 58 and a buoyancy portion 59 at one end of the elongate portion 58. A handle portion 60 is located at the opposed end of the buoyancy portion 59. The buoyancy portion 59 has a dumbbell shaped cross section. A transverse portion in the form of a cross bar 62 is located adjacent the handle portion 60 and substantially at right angles to the elongate portion 58.

The floatable lever 52 is attached to the front side wall 63 of the basin 55 by two member guides 64. The two member guides 64 are fixed to the side wall 63 of the basin 55. The elongate portion 58 of the floatable lever 52 is retained by the two member guides 64 but can rise and fall with the level of water in the chamber 53.

The cistern housing 65 includes a lid 67 with a slot 68 and two guide flanges 70 on the underside of the lid 67. The flanges 70 are spaced apart by the slot 68. When the floatable lever 52 is positioned in the cistern housing 65, the handle portion 60 passes through the slot 68 in the lid 67. The cross bar 62 is positioned below the slot 68 and can abut the guide flanges 70.

The two guide flanges 70 are adjacent either longitudinal side of the slot 68. Each guide flange 70 has a substantially arcuate and substantially concave shape with two ends 71, 72. Each of the two ends form an abutment side 71, 72 to retain the cross bar 62 in a fixed position for a short period of time and thereby hold the basin 55 in a tilted position.

When there is a low level of water in the basin 55, the floatable lever 52 is positioned with the cross bar 62 below the slot 68 and the cross bar 62 is not engaged with the guide flanges 70. This is shown in FIGS. 7A and 7B. As water fills the basin 55, the buoyancy portion 59 causes the floatable lever 52 to rise. The cross bar 62 rises with the floatable lever 52 to engage the guide flanges 70. This is shown in FIGS. 8A and 8B. The floatable lever 52 is configured so that the cross bar 62 engages with the guide flanges 70 when the basin 55 is filled with water to at least half the predetermined volume of the chamber 53.

In order to perform a flush, the basin 55 is tilted by deflecting the floatable lever 52 so that the cross bar 62 moves towards one end 71 or 72 of the guide flanges 70 and engages with respective abutment side 71 or 72. This is shown in FIGS. 9A and 9B. Due to buoyancy of the floatable lever 52 and the tendency for the basin 55 to return to its initial position, the cross bar 62 is held in a fixed position against the abutment side 71 or 72.

The floatable lever 52 is configured so that the cross bar 62 is held in a fixed position against the abutment side 71 or 72 when there is at least half the predetermined volume of water in the chamber 53. This volume of water keeps the floatable lever 52 in a raised position so that the cross bar 62 is prevented from moving beyond the abutment side 72 of the guide flange 70 (as shown in FIGS. 9A and 9B). As a consequence the basin 55 is held in the tilted position to actuate discharge of water through the passageway 56.

As the water discharges from the chamber 53, the position of the floatable lever 52 falls with the water level. When the water level falls below about half the predetermined volume of water in the chamber 53, the cross bar 62 drops below the guide flange 70 and therefore the abutment side 72 no longer resists the tendency for basin 55 to return to its initial position. As the basin 55 refills with water from the water supply as described above for the cistern assembly 11, the basin 55 returns to its initial position with the floatable lever 52 in the substantially vertical position.

The floatable lever 52 is configured to position the buoyancy portion 59 between a full flush water level and a half flush water level when the chamber 53 is filled with the predetermined volume of water. The full flush water level is the level of water in the basin 55 when the basin 55 is filled with the predetermined volume of water in the chamber 53. The half flush water level is the level of water when the basin 55 is half filled with the predetermined volume of water. The positioning of the buoyancy position 59 relative to the half flush water level is important to enable the floatable lever 52 to move downwardly for a distance sufficient for the cross bar 62 to move below the guide flanges 70 during the operation of a half flush.

Figure 10:
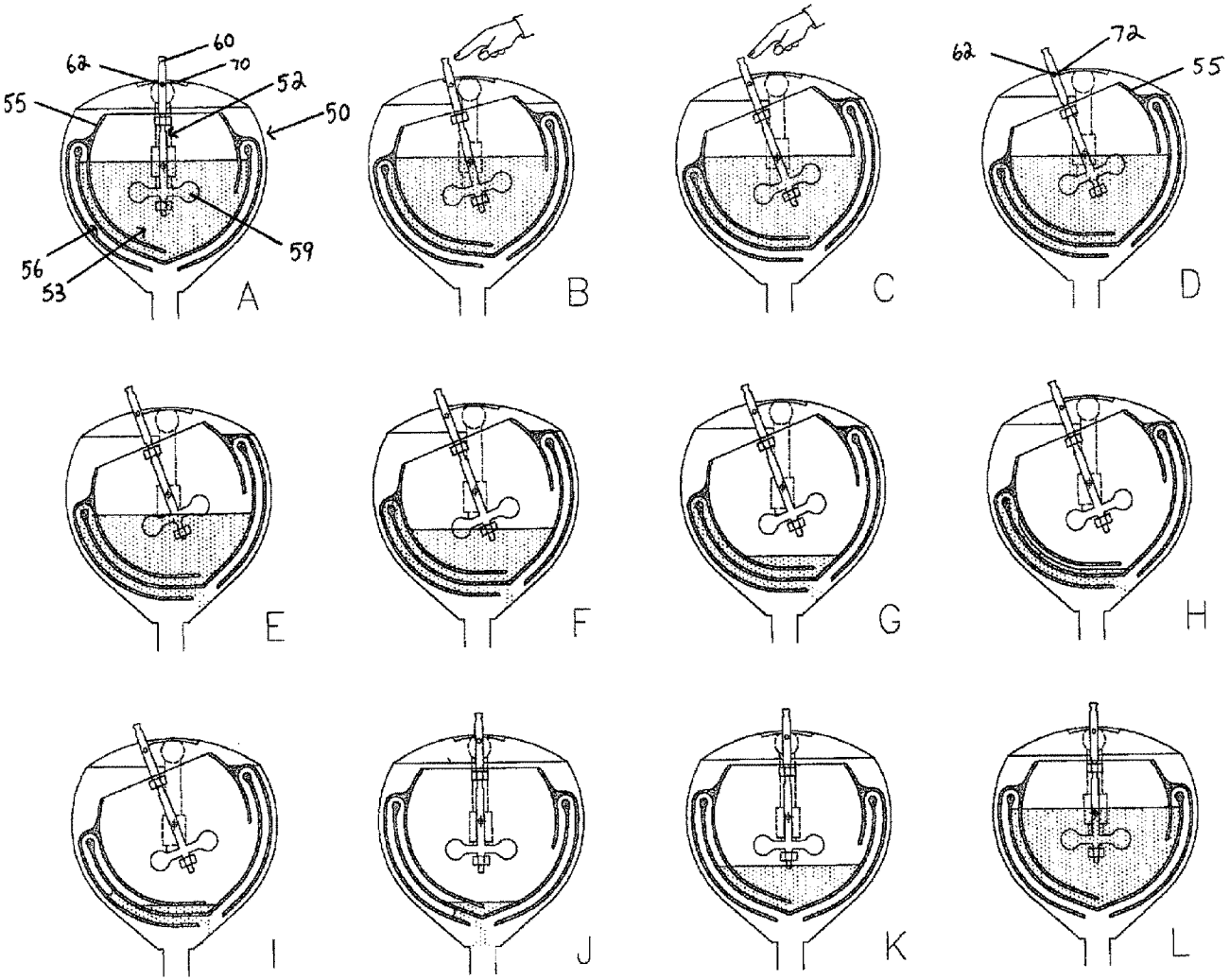
FIG. 10 shows a series of diagrammatic views of the cistern assembly as shown in FIG. 7A in a sequence of steps during a full flush of the flush toilet.
Figure 11:
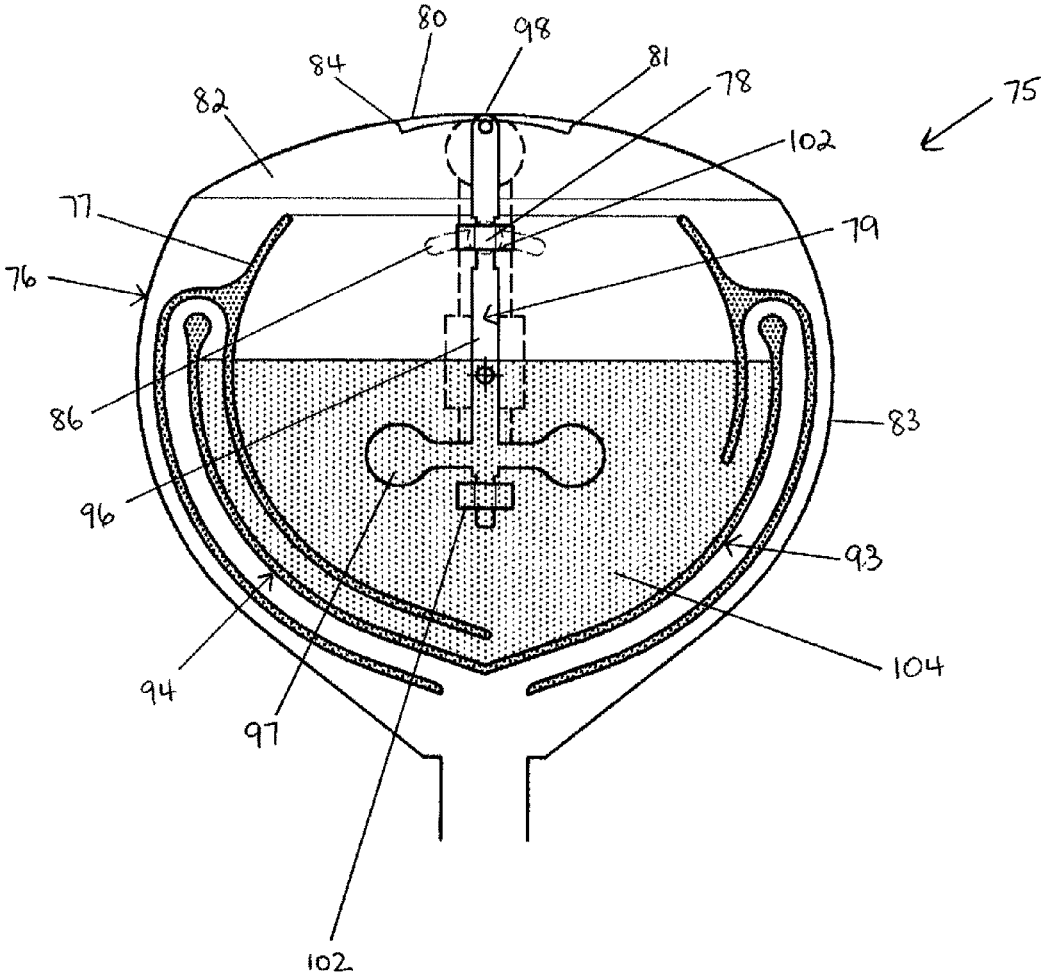
FIG. 11 is a front cross sectional view of a cistern assembly according to a third embodiment of the cistern assembly where a float valve and water inlet are shown in phantom.
Figure 12:
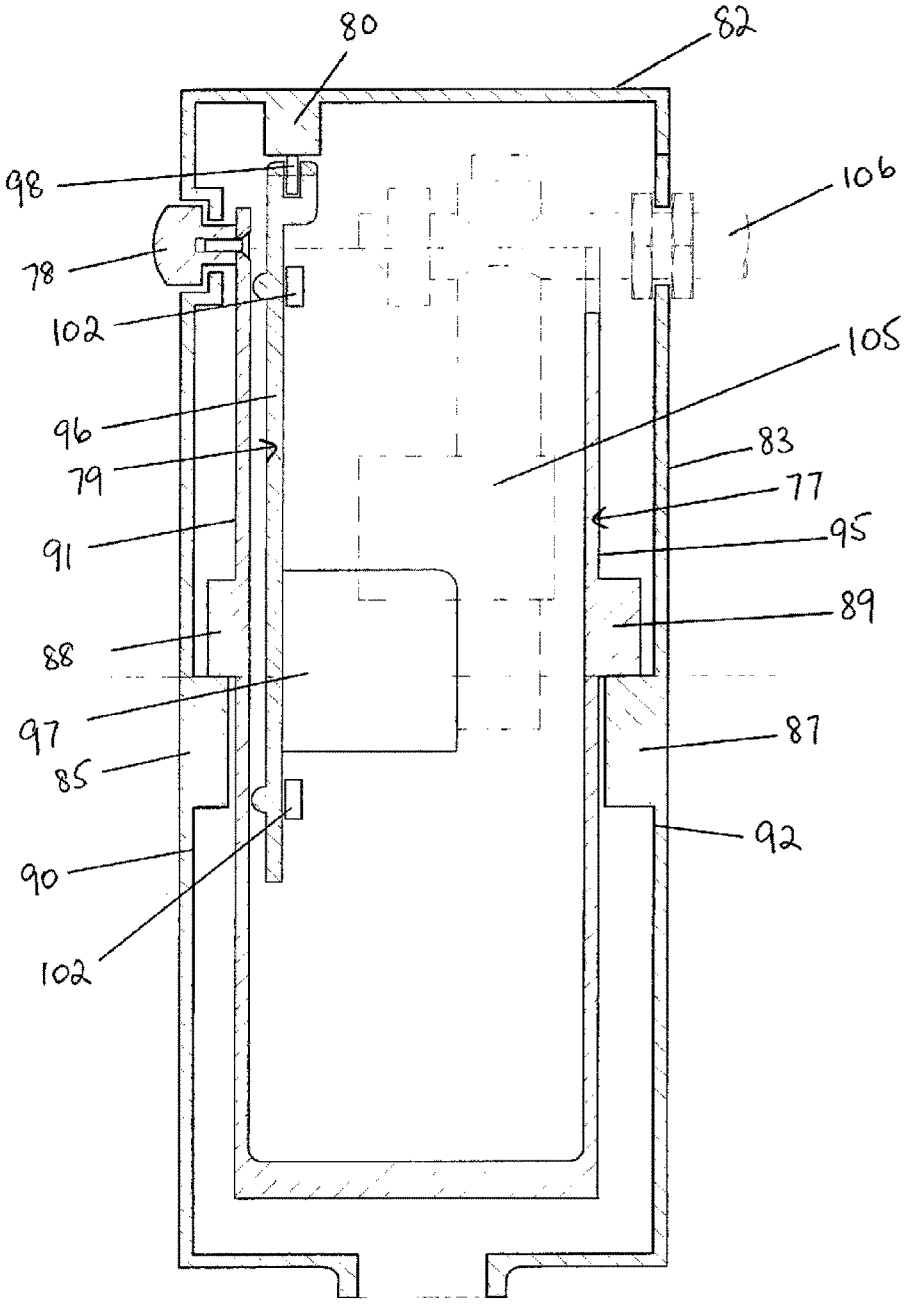
FIG. 12 is a side cross sectional view of the cistern assembly as shown in FIG. 11.
Figure 13:
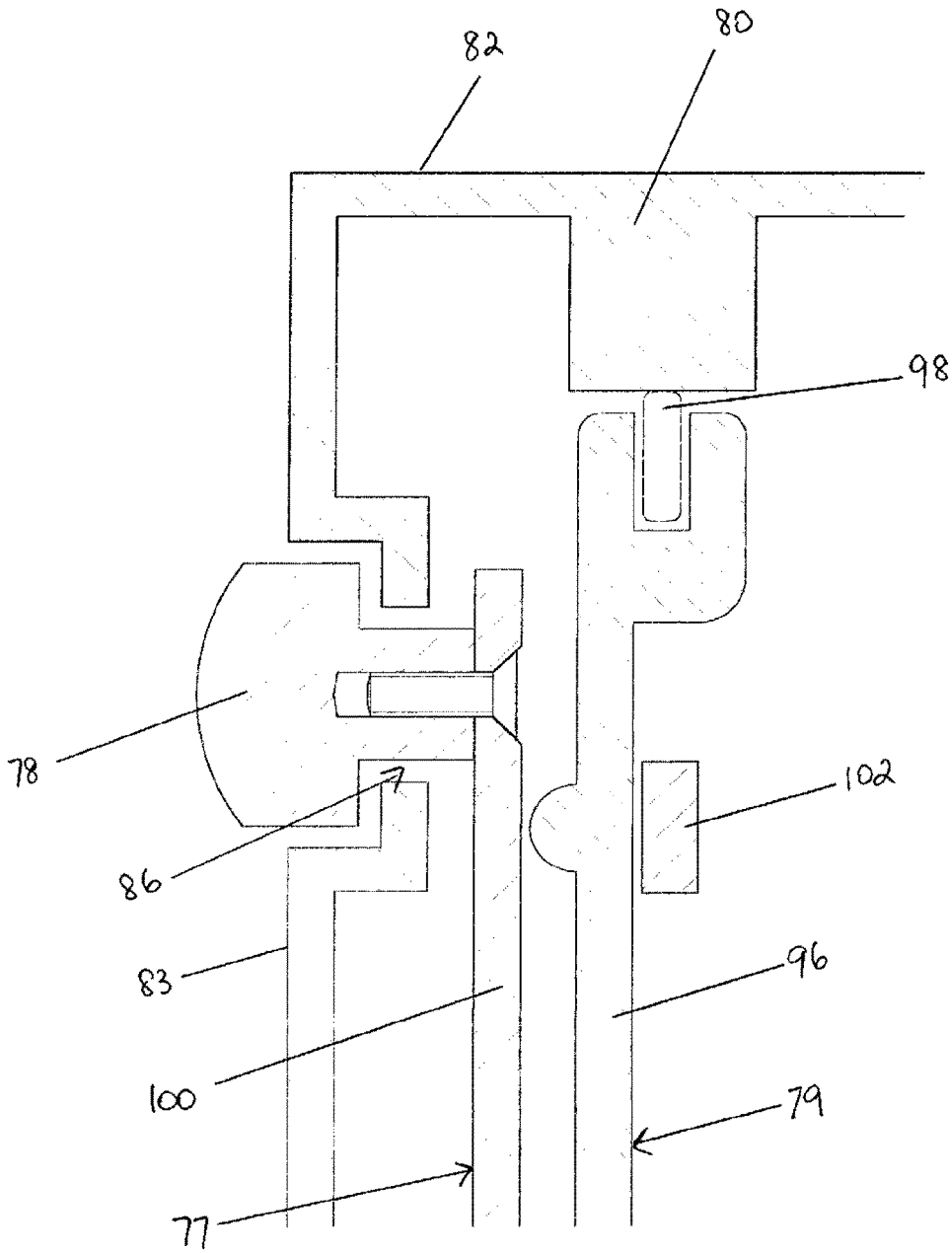
FIG. 13 is a part cross sectional view of the cistern assembly as shown in FIG. 11.

In use, the floatable lever 52 is moved to tilt the basin 55 within the cistern housing 65 in an anticlockwise direction to actuate a full flush (as shown in FIG. 10.). In order to actuate a half flush, the floatable lever 52 is moved in a clockwise direction (not shown in the Figures). The steps that occur during a full flush and a half flush of the cistern assembly 50 is similar to the steps that occur during a full flush and half flush of the cistern assembly 11 described above.

With reference to FIGS. 11 to 14, there is shown a third embodiment of a cistern assembly 75. The cistern assembly 75 includes a cistern housing 76, a basin 77 that is positioned within the cistern housing 76, a handle 78 for tilting the basin 77 relative to the cistern housing 76 and a floatable latch 79 for holding the basin 77 in a tilted position to actuate the discharge of water from basin 77 through passageway 93 or 94.

The cistern housing 76 has a lid 82 and a housing base 83.

The housing base 83 has two housing pivot portions 85, 87 that protrude from opposed inner sidewalls 90, 92, respectively, of the housing base 83. The basin 77 is positioned within the housing base 83 and pivotally mounted to the cistern housing 76 via the two housing pivot portions 85, 87. The housing base 83 has an arcuate slot 86 for the handle 78 to pass through when the basin 77 is mounted within the housing base 83.

The lid 82 has an inner guide flange 80 with two abutment sides 81, 84. The lid 82 is positioned over the housing base 83 so that the floatable latch 79 can engage with the inner guide flange 80 when there is at least half the predetermined volume of water in the chamber 104 of the basin 77.

The basin 77 is similar to the basin 16 of the cistern assembly 11 described above except that the basin 77 is tilted relative to the cistern housing 76 by the handle 78 that is fixed to a side wall 91 of the basin 77.

The basin 77 has two basin pivot portions 88, 89 that protrude from opposed side walls 91, 95 respectively, of the basin 77. The two basin pivot portions 88, 89 engage housing pivot portions 85, 87 respectively, of the housing base 83. The basin 77 is pivotally mounted within the cistern housing 76 by the mounting of the basin pivot portions 88, 89 with the housing pivot portions 85, 87

The basin 77 has two passageways 93, 94 that are of different lengths. A different volume of water is discharged from the basin 77 depending on whether the basin 77 is tilted towards the left-hand side or the right-hand side of the cistern housing 76.

The floatable latch 79 has an elongate portion 96 and a buoyancy portion 97. The buoyancy portion 97 is located a bottom end of the elongate portion 96 while a follower wheel 98 is located at a top end of the elongate portion 96. The floatable latch 79 is positioned by two member guides 102 to retain the floatable latch 79 to the side wall 91 of the basin 77. The two member guides 102 are fixed to the side wall 91 of the basin 77 and retain the elongate portion 96 of the floatable latch 79 whilst allowing the floatable latch 79 to rise and fall with the level of water in the basin 77.

The floatable latch 79 is not integrally formed with the handle 78 but is operatively associated with the handle 78, so that when the handle moves laterally the float latch 79 cooperatively moves laterally. The float latch 79 can rise and fall independent of the handle 78. Because the floatable latch 79 is retained by the member guides 102 to the side wall 91 of the basin 77, the basin and the floatable latch 79 tilt simultaneously when the handle 78 is moved and tilts the basin 77.

Figure 14:
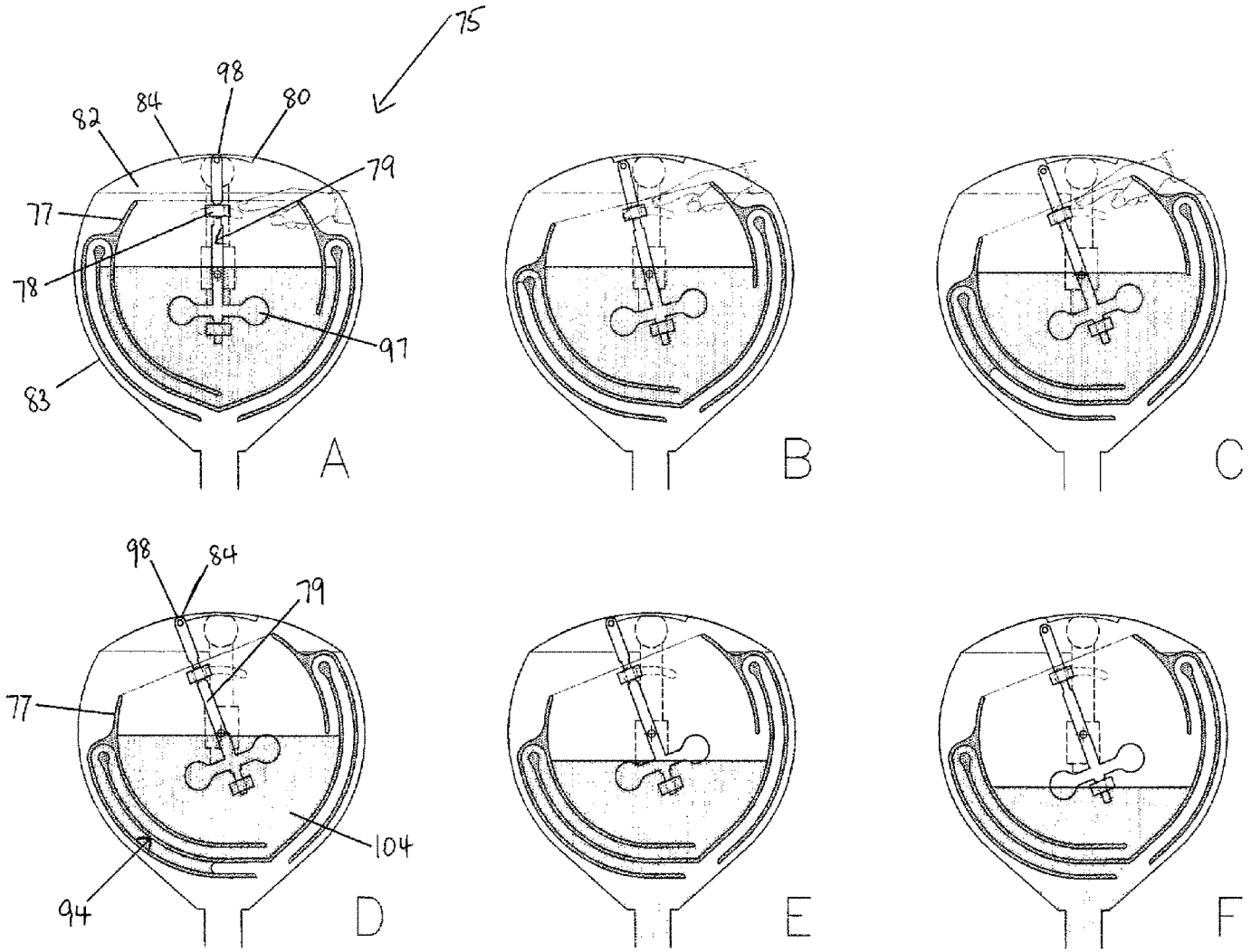
FIG. 14 shows a series of diagrammatic views of the cistern assembly as shown in FIG. 11 in a sequence of steps during a full flush.
Figure 14:
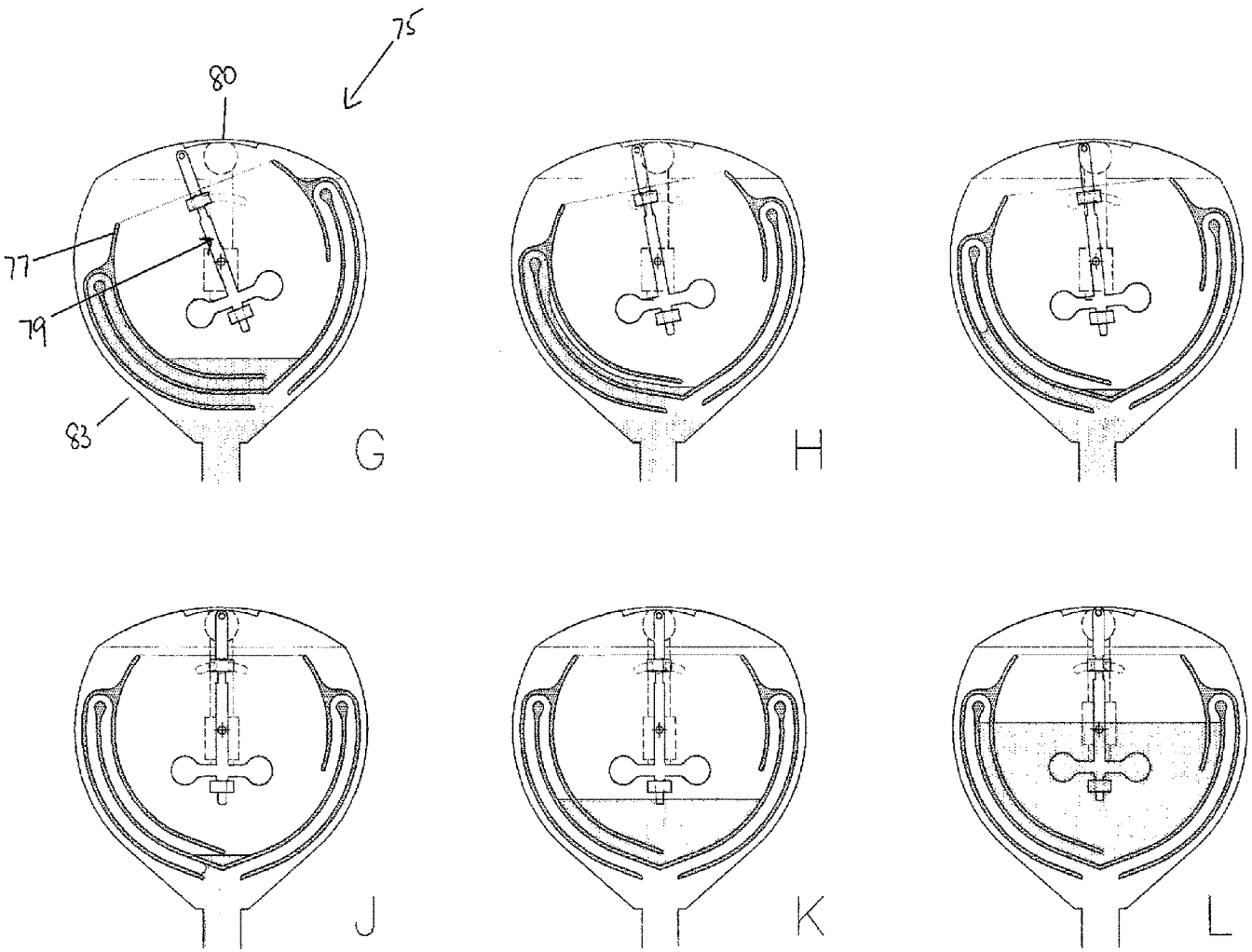

In order to perform a full flush, the handle 78 is used to tilt the basin 77 towards the left-hand side of the cistern housing 76. The steps that occur during a full flush are shown in FIG. 14. In order to perform a half flush, the handle 78 is pushed to tilt the basin 77 towards the right-hand side of the cistern housing 76.

The floatable latch 79 has buoyancy that enables the follower wheel 98 to travel along the guide flange 80 and be held in a fixed position against one of the abutment side 84. The floatable latch 79 is maintained abutted against the abutment side 84 when there is about half or more of the predetermined volume of water in the chamber 104 of the basin 77. This volume of water keeps the floatable latch 79 in a raised position to resist the tendency for the basin 77 to return to its initial position by preventing the follower wheel 98 from moving beyond the abutment side 84 of the guide flange 80 (as shown in FIGS. 14(D) and (E)). As a consequence the basin 77 is held in a tilted position to actuate discharge of water through the passageway 94.

As the water discharges from the chamber 104, the position of the floatable latch 79 falls with the water level. When the water level falls below about half the predetermined volume of the water in the chamber 104, the floatable latch 79 is in a lowered position and the floatable latch 79 no longer abuts the abutment side 84. The floatable latch 79 then moves towards a substantially vertical position while water continues to discharge through the passageway 94. Discharge of water stops when air enters and breaks the siphoning action in passageway 94.

The chamber 104 is then refilled with water from the water inlet 106. The volume of water in the chamber 104 is controlled by a float valve 105 positioned near the water inlet 106. The float valve 105 stops entry of water into the chamber 104 when the predetermined water level is reached.

Figure 15:
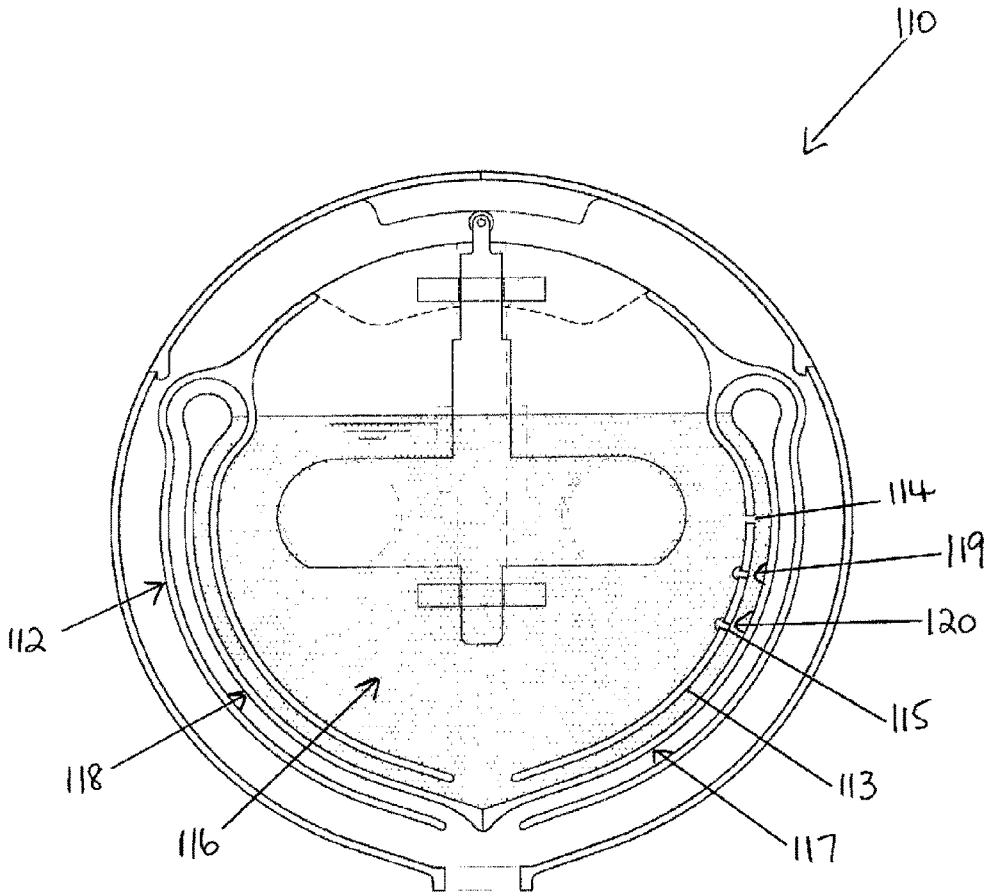
FIG. 15 is a cross sectional view of cistern assembly according to a fourth embodiment of the cistern assembly.
Figure 16:
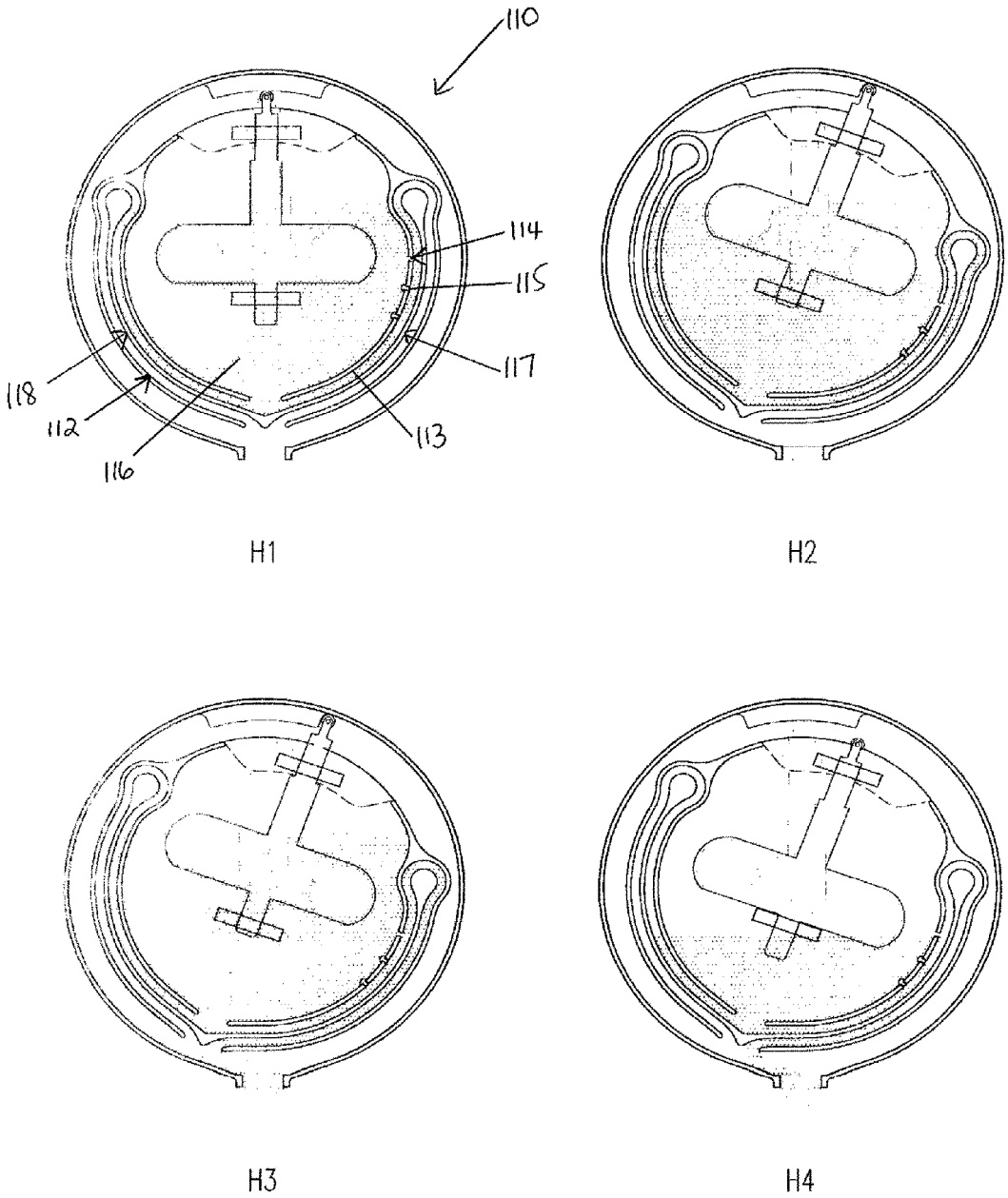
FIG. 16 is a series of diagrammatic views of the cistern assembly as shown in FIG. 15 in a sequence of steps during a partial flush.
Figure 16:
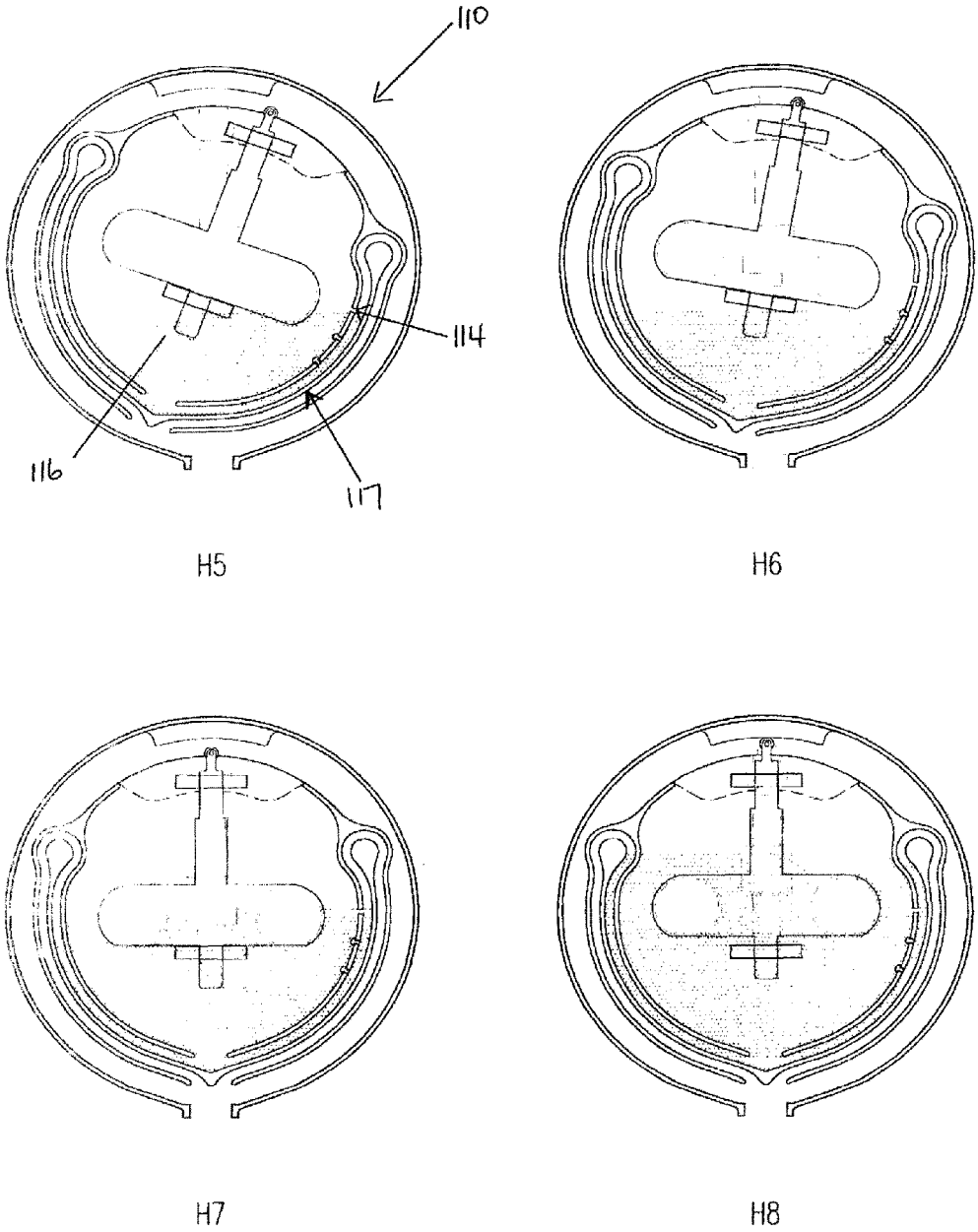
Figure 17:
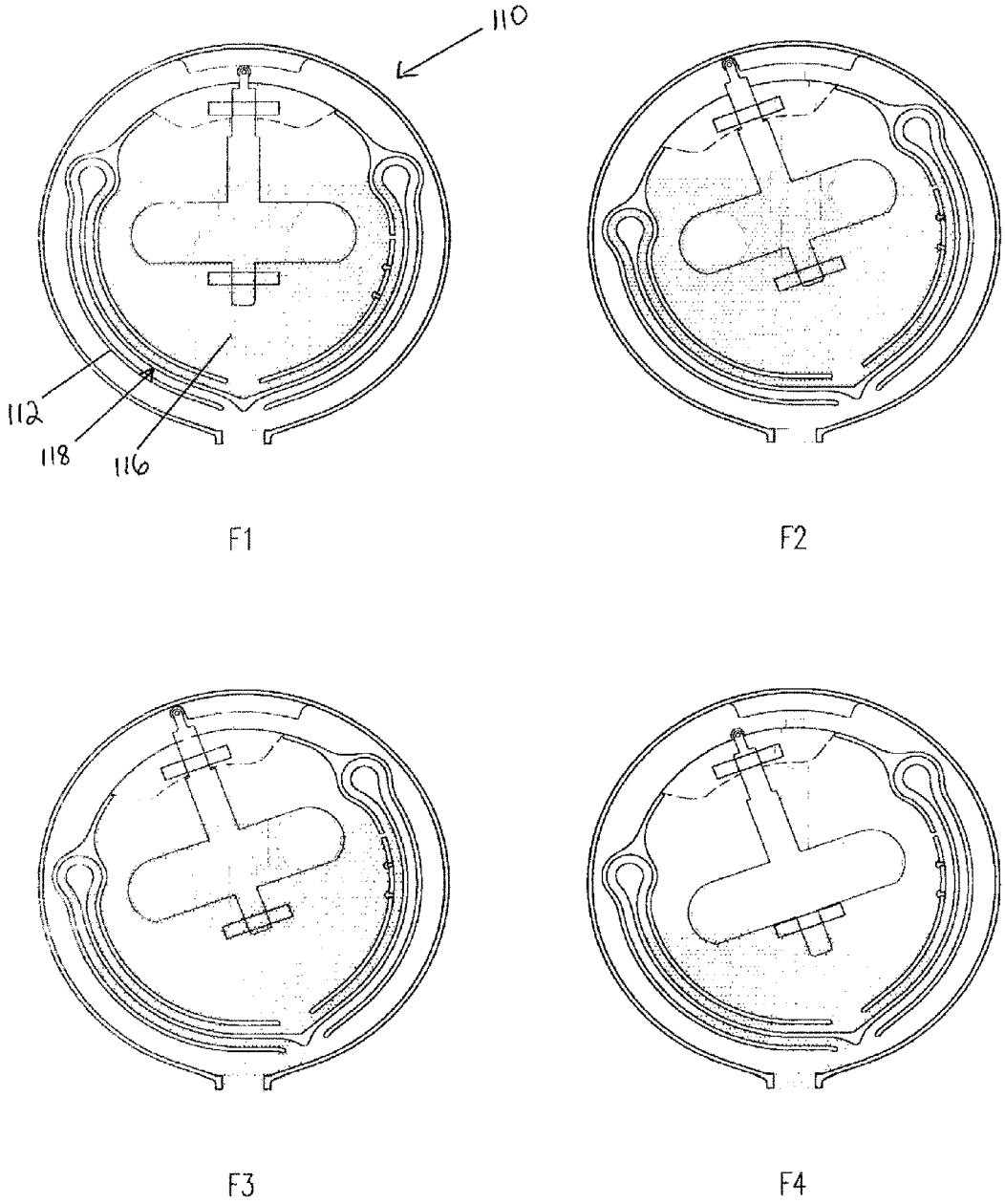
FIG. 17 is a series of diagrammatic views of the cistern assembly as shown in FIG. 15 in a sequence of steps during a full flush.
Figure 17:
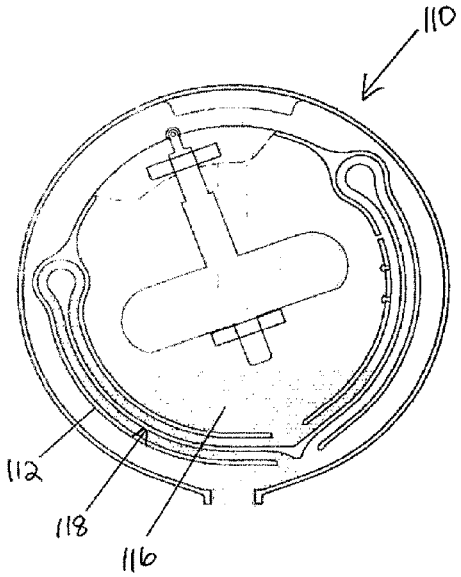
Figure 17:
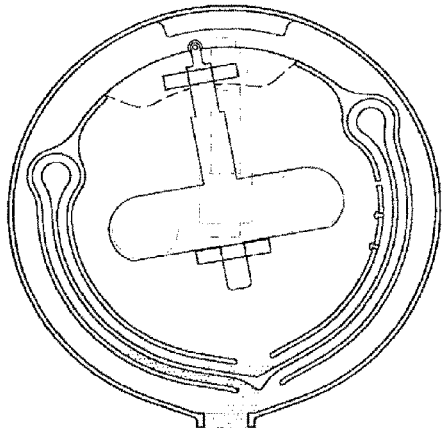
Figure 17:
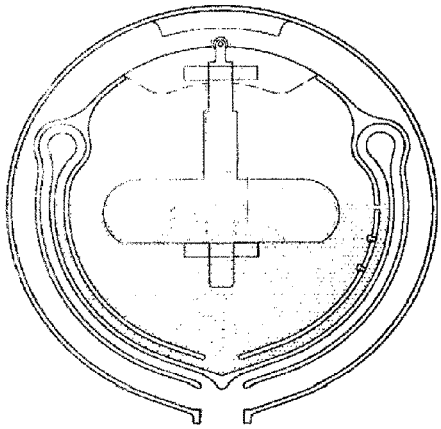
Figure 17:
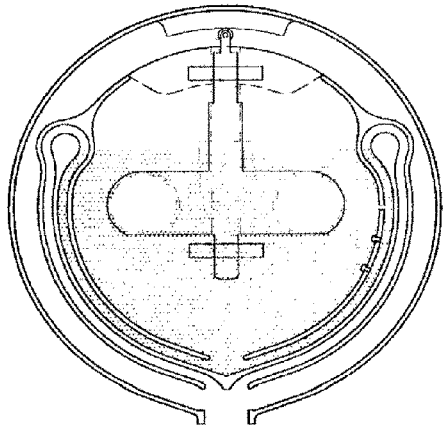

With reference to FIGS. 15 to 17, there is shown another embodiment of the cistern assembly 110. The cistern assembly 110 is similar to the cistern assembly 75 except that the cistern assembly 110 has a basin 112 that is capable of discharging four different volumes of water. The basin 112 has a right-hand passageway 117 with an inner side wall 113. The inner side wall 113 has three apertures 114, 119, 120. The apertures 114, 119, 120 can be closed with the positioning of a removable seal 115. With respect to FIG. 15, apertures 119 and 120 are closed by seals 115 while the aperture 114 remains open. Each of the apertures 114, 119, 120 can be plugged with a removable seal 115 to alter the effective length of the passageway 117. The effective length of the passageway 117 increases as apertures 114, 119 and 120 are successively plugged. The effective length of the passageway 117 in turn determines the volume of water that is discharged from the chamber 116.

The three spaced apart apertures in the inner side wall 113 provides a person with the option of selecting one of three different volumes of water to be discharged. If all apertures are plugged then there is a fourth option of a full volume flush. With the aperture 114 open, a lower volume of water will be discharged compared with the volume of water discharged when only aperture 120 is open. As water is discharged and air passes though the open aperture, the siphoning action is broken and water is not drawn into the passageway 117.

FIG. 16 shows the steps during a partial flush with aperture 114 open. Alternatively, the upper aperture 114 can be plugged and the middle aperture 119 or lower aperture 120 is unplugged to increase the volume of water discharged through the passageway 117. When all three apertures 114, 119, 120 are plugged, a volume of water for a full flush can be discharged through the passageway 117. The cistern assembly 110 operates in a way similar to the cistern assembly 75 described above.

Only a volume of water for a full flush can be discharged from the left-hand passageway 118 of the basin 112. FIG. 17 shows the steps during a full flush.

Advantages

An advantage of the preferred embodiment of the cistern assembly is the provision of a simple flush arrangement without separate moving parts for a flush toilet. A further advantage of the preferred embodiment of the cistern assembly is that the simplicity of the design reduces the number of parts in the assembly and therefore reduces the amount of maintenance required during the lifetime of the cistern assembly.

Another advantage of the preferred embodiment of the cistern assembly is the elimination of the need for a valve to effectively seal the cistern outlet thereby avoiding the problem of water loss and consequences thereof if the seal is ineffective.

Another advantage of the preferred embodiment of the cistern assembly is the provision of a choice of two volumes of water for flushing the toilet bowl.

A further advantage of the preferred embodiment of the cistern assembly is the provision of a floatable latch that can be positioned to hold the cistern member in a tilted position to actuate discharge of water through the passageway.

Variations

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, portions, integers or steps.

The invention claimed is:

1. A cistern assembly for a flush toilet including a cistern housing;

a cistern member pivotally attached within the cistern housing, the cistern member has a base wall that forms a chamber to store water and a passageway to discharge water from the chamber, the passageway has an internal inlet and a cistern outlet and is shaped to siphon water through the passageway; and an actuator associated with the cistern member to pivot the cistern member relative to the cistern housing wherein when the cistern member is pivoted and the passageway is moved below the water level of the stored water of the chamber, the water is drawn through the passageway to the cistern outlet until air within the chamber enters the passageway preventing further water from being drawn into the passageway.

2. A cistern assembly for a flush toilet including a cistern housing;

a cistern member pivotally attached within the cistern housing, the cistern member has a base wall that forms a chamber to store water and a passageway to discharge water from the chamber, the passageway has an internal inlet and a cistern outlet and is shaped to siphon the water when the hydrostatic pressure within the passageway is lower than the atmospheric pressure in the chamber thereby drawing water through the passageway; and an actuator associated with the cistern member to pivot the cistern member relative to the cistern housing wherein when the cistern member is pivoted and the passageway is moved below the water level of the stored water of the chamber, the water is drawn through the passageway to the cistern outlet until air within the chamber enters the passageway preventing further water from being drawn into the passageway.

3. A cistern assembly as claimed in claim 2, wherein the cistern housing preferably includes a cistern lid and a cistern base.

4. A cistern assembly for a flush toilet including a cistern housing including a cistern lid and a cistern base;

a cistern member pivotally attached within the cistern housing, the cistern member has a base wall that forms a chamber to store water and a passageway to discharge water from the chamber, the passageway has an internal inlet and a cistern outlet and is shaped to siphon water through the passageway; and an actuator associated with the cistern member to pivot the cistern member relative to the cistern housing, wherein said actuator can tilt the cistern member to actuate discharge of water through the passageway, and when the cistern member is pivoted and the passageway is moved below the water level of the stored water of the chamber, the water is drawn through the passageway to the cistern outlet until air within the chamber enters the passageway preventing further water from being drawn into the passageway.

5. A cistern assembly as claimed in claim 4, wherein the passageway has a first section formed within the chamber and a second section formed outside the chamber, the first section and the second section enable continuous fluid communication between the internal inlet of the passageway and the cistern outlet, said first section is formed by an inner side wall and a base wall, and the second section is formed by an outer side wall and the base wall.

6. A cistern assembly as claimed in claim 4, wherein the passageway has a first section formed within the chamber and a second section formed outside the chamber, the first section and the second section enable continuous fluid communication between the internal inlet of the passageway and the cistern outlet, said first section is formed by an inner side wall and a base wall, and the second section is formed by an outer side wall and the base wall, wherein the first section and the second section are connected by a substantially U-shaped portion; the first section, the substantially U-shaped portion and the second section have internal dimensions that are substantially the same.

7. A cistern assembly as claimed in claim 4, wherein the passageway has a first section formed within the chamber and a second section formed outside the chamber, the first section and the second section enable continuous fluid communication between the internal inlet of the passageway and the cistern outlet, said first section is formed by an inner side wall and a base wall, and the second section is formed by an outer side wall and the base wall, wherein the first section and the second section are connected by a substantially U-shaped portion; the first section, the substantially U-shaped portion and the second section have internal dimensions that are substantially the same, wherein the length of the inner side wall determines the length of the passageway and the volume of water to be discharged.

8. A cistern assembly as claimed in claim 4, wherein the passageway has a first section formed within the chamber and a second section formed outside the chamber, the first section and the second section enable continuous fluid communication between the internal inlet of the passageway and the cistern outlet, said first section is formed by an inner side wall and a base wall, and the second section is formed by an outer side wall and the base wall, wherein the first section and the second section are connected by a substantially U-shaped portion; the first section, the substantially U-shaped portion and the second section have internal dimensions that are substantially the same, wherein the inner side wall has an aperture between the chamber and the passageway thereby limiting the volume of water to be discharged.

9. A cistern assembly as claimed in claim 4, wherein the passageway has a first section formed within the chamber and a second section formed outside the chamber, the first section and the second section enable continuous fluid communication between the internal inlet of the passageway and the cistern outlet, said first section is formed by an inner side wall and a base wall, and the second section is formed by an outer side wall and the base wall, wherein the first section and the second section are connected by a substantially U-shaped portion; the first section, the substantially U-shaped portion and the second section have internal dimensions that are substantially the same, wherein the inner side wall has a plurality of apertures, the aperture which defines a predetermined volume of water remains open while at least the apertures defining smaller volumes of water are closed with a seal.

10. A cistern assembly as claimed in claim 4, wherein the cistern member has a plurality of passageways to enable different volumes of stored water to be discharged from the chamber.

11. A cistern assembly as claimed in claim 4, wherein the cistern member has two passageways to enable the choice of two different volumes of stored water to be discharged from the chamber.

12. A cistern assembly as claimed in claim 4, wherein a first passageway enables substantially all of the predetermined volume of water to be discharged from the chamber, and a second passageway enables about half of the predetermined volume of water to be discharged from the chamber.

13. A cistern assembly as claimed in claim 4, wherein the cistern member has a substantially semi-circular cross-section and the base wall is substantially concave in shape, said cistern member has a center of gravity lower than its pivot point thereby enabling the cistern member to be self righting returning from an inclined position to an upright position when the cistern member is substantially emptied of water.

14. A cistern assembly as claimed in claim 4, wherein the cistern member is pivotally mounted to the cistern housing and is pivotal about a vertical axis positioned substantially in the center of the cistern member.

15. A cistern assembly as claimed in claim 4, wherein the actuator includes a lever pivotally mounted to the cistern housing and pivots with the cistern member.

16. A cistern assembly as claimed in claim 4, wherein the actuator includes a lever portion and a floatation portion as a single integral or assembled member, the lever portion includes a transverse pin for use as a latch to abut against the surface of a latch guide, the lever portion extends through an elongate lid aperture and serves as a handle to tilt the cistern member.

17. A cistern assembly as claimed in claim 4, wherein the actuator includes a lever portion and a floatation portion as a single integral or assembled member, the lever portion includes a transverse pin for use as a latch to abut against the surface of a latch guide, the lever portion extends through an elongate lid aperture and serves as a handle to tilt the cistern member, wherein the integral or assembled lever portion and the floatation portion are captured by one or more member guides which are fixed to the side wall of the cistern member, so that it can move up and down according to the water level within the cistern member.

18. A cistern assembly as claimed in claim 4, wherein the actuator includes a handle for moving the cistern member relative to the cistern housing and a floatable member for latching the cistern member in the tilted position.

19. A cistern assembly as claimed in claim 4, wherein the actuator includes a handle for moving the cistern member relative to the cistern housing and a floatable member for latching the cistern member in the tilted position, and the floatable member includes an elongate portion and a buoyancy portion, the buoyancy portion is positioned near one end of the floatable member and the buoyancy portion has sufficient buoyancy to cause the floatable member to move up and down with the level of the water in the cistern member.

20. A cistern assembly as claimed in claim 4, wherein the actuator includes a handle for moving the cistern member relative to the cistern housing and a floatable member for latching the cistern member in the tilted position, and the floatable member is positionable in the center of the cistern member and the floatable member is captured by two spaced apart one or more member guides that are attached to a side wall of the cistern member so that the floatable member can rise and fall with the level of the water in the cistern member.

21. A cistern assembly as claimed in claim 4, wherein the actuator includes a handle for moving the cistern member relative to the cistern housing and a floatable member for latching the cistern member in the tilted position, the floatable member is positionable in the center of the cistern member and the floatable member is captured by two spaced apart one or more member guides that are attached to a side wall of the cistern member so that the floatable member can rise and fall with the level of the water in the cistern member, and the elongate portion preferably has a latch formed at one end to engage a latch guide.

22. A cistern assembly as claimed in claim 4, wherein the actuator includes a handle for moving the cistern member relative to the cistern housing and a floatable member for latching the cistern member in the tilted position, the floatable member is captured by two spaced apart one or more member guides that are attached to a side wall of the cistern member so that the floatable member can rise and fall with the level of the water in the cistern member, and the elongate portion has a roller or wheel to facilitate movement of the floatable member along the latch guide.

23. A cistern assembly as claimed in claim 4, wherein the actuator includes a handle for moving the cistern member relative to the cistern housing and a floatable member for latching the cistern member in the tilted position, and the handle includes a button that extends from the cistern member side wall, said button is attached to or integral with the cistern member, and the handle is associated with the floatable member so that when the handle member moves laterally the floatable member correspondingly moves laterally but the floatable member retains independent movement up and down with the level of the water in the cistern member.

24. A flush toilet including a cistern assembly as claimed in claim 4; and a toilet bowl wherein the cistern assembly discharges water into the toilet bowl.

* * * * *